US007857666B2

(12) United States Patent
Chen et al.

(10) Patent No.: US 7,857,666 B2
(45) Date of Patent: Dec. 28, 2010

(54) CABLE CONNECTOR AND METHOD OF MAKING THE SAME

(75) Inventors: Wu-Kuang Chen, Taipei Hsien (TW); Hsiaw-Chiang Chen, Taipei Hsien (TW); Min-Qiang Zhang, Shenzhen (CN); Chang-Hua Liao, Shenzhen (CN); Guo-Zhong Liu, Shenzhen (CN); Yong-Liang Chen, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 134 days.

(21) Appl. No.: 12/200,860

(22) Filed: Aug. 28, 2008

(65) Prior Publication Data

US 2009/0305574 A1 Dec. 10, 2009

(30) Foreign Application Priority Data

Jun. 4, 2008 (CN) ..... 2008 1 0301997

(51) Int. Cl.
*H01R 24/00* (2006.01)

(52) U.S. Cl. ..... 439/675; 439/76.1

(58) Field of Classification Search ..... 439/675, 439/680, 620.01, 620.21, 76.1
See application file for complete search history.

(56) References Cited

U.S. PATENT DOCUMENTS

| | | | | |
|---|---|---|---|---|
| 5,449,302 | A * | 9/1995 | Yarbrough et al. | 439/680 |
| 5,759,069 | A * | 6/1998 | Kitatani et al. | 439/675 |
| 7,147,518 | B2 * | 12/2006 | Marechal et al. | 439/675 |
| 7,661,995 | B2 * | 2/2010 | Nania et al. | 439/681 |

* cited by examiner

*Primary Examiner*—Tho D Ta
*Assistant Examiner*—Travis Chambers
(74) *Attorney, Agent, or Firm*—Zhigang Ma

(57) ABSTRACT

An exemplary cable connector includes a terminal module, a latching flange, and a housing. The terminal module includes a first terminal, a second terminal, and an insulator. The first terminal and the second terminal are insulated by the insulator. The latching flange is fixed on an outer surface of the terminal module. The housing is fixed on a periphery of the terminal module. The latching flange forms at least one resisting surface. An inner surface of the housing defines a latching groove corresponding to the latching flange. The latching groove forms at least one resisting surface corresponding to the at least one resisting surface of the latching flange. The latching flange is latched in the latching groove.

10 Claims, 3 Drawing Sheets

CABLE CONNECTOR AND METHOD OF MAKING THE SAME

BACKGROUND OF THE INVENTION

1. Field of the Invention

The present invention relates to a cable connector and a method of making the same.

2. Description of the Related Art

Electronic devices, such as cell phones, notebooks, personal digital assistants, and so on, are widely used in recent years. Generally, these electronic devices are configured to have rechargeable batteries. Thus, a cable connector is provided to electrically connect a power source to an electronic device, such that the power source is able to recharge the battery in the electronic device.

Generally, a cable connector includes a housing, a status indicator, a terminal module, and a printed circuit board. The printed circuit board is disposed in the housing. The terminal module and the status indicator are electrically connected to the printed circuit board. Generally, a method of manufacturing the cable connector includes following steps. Firstly, make an insulating housing. Secondly, a status indicator, a terminal module, and a printed circuit board are provided to be positioned in the housing, with the terminal module and the status indicator electrically connected to the printed circuit board. However, the terminal module is easily detached from the printed circuit board or rotated relative to the printed circuit board, thereby damaging the cable connector.

Therefore, a new cable connector is desired in order to overcome the above-described shortcomings.

SUMMARY

A cable connector includes a terminal module, a latching flange, and a housing. The terminal module includes a first terminal, a second terminal, and an insulator. The first terminal and the second terminal are insulated by the insulator. The latching flange is fixed on an outer surface of the terminal module. The housing is fixed on an outer surface of the terminal module. The latching flange forms at least one resisting surface. An inner surface of the housing defines a latching groove corresponding to the latching flange. The latching groove forms at least one resisting surface corresponding to at least one resisting surface of the latching flange.

Other advantages and novel features will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present cable connector. Moreover, in the drawings, like reference numerals designate corresponding parts throughout several views, and all the views are schematic.

DETAILED DESCRIPTION OF THE EMBODIMENTS

Reference will now be made to the drawings to describe embodiments of the present cable connector in detail.

Figure 1:
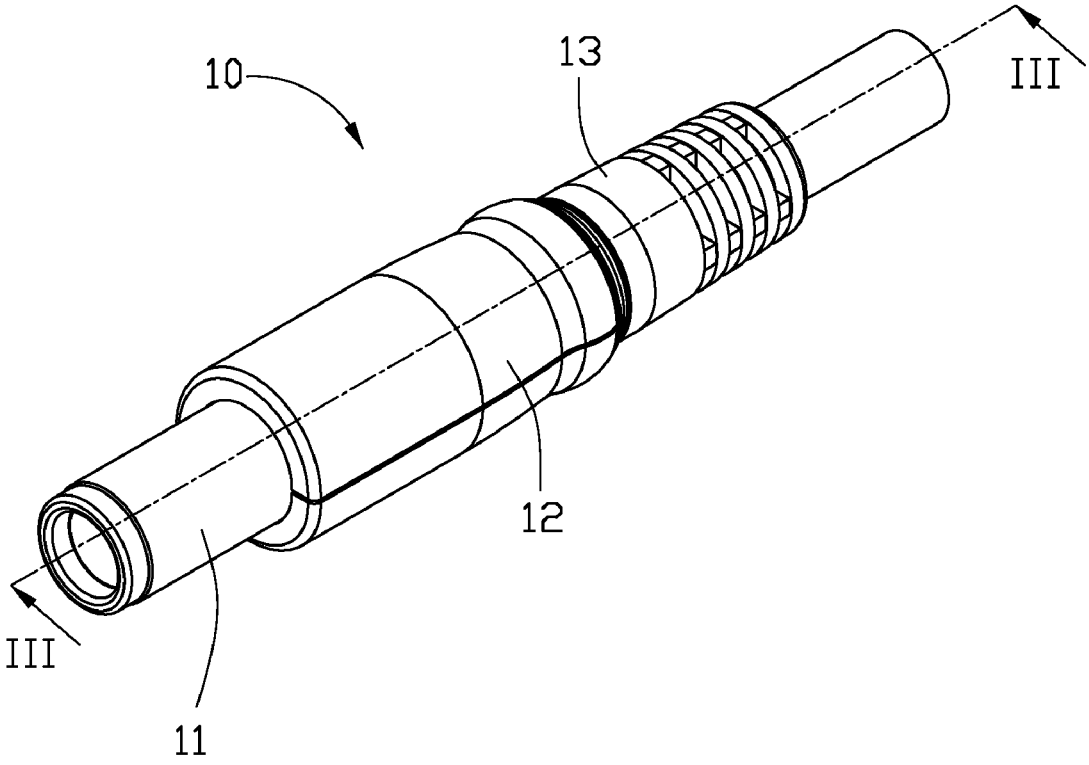
FIG. 1 is an isometric view of a cable connector in accordance with an exemplary embodiment of the present invention.

Referring to FIG. 1, a cable connector 10 includes a terminal module 11 and a housing 12. The cable connector 10 is electrically connected to a cable 13.

Figure 2:
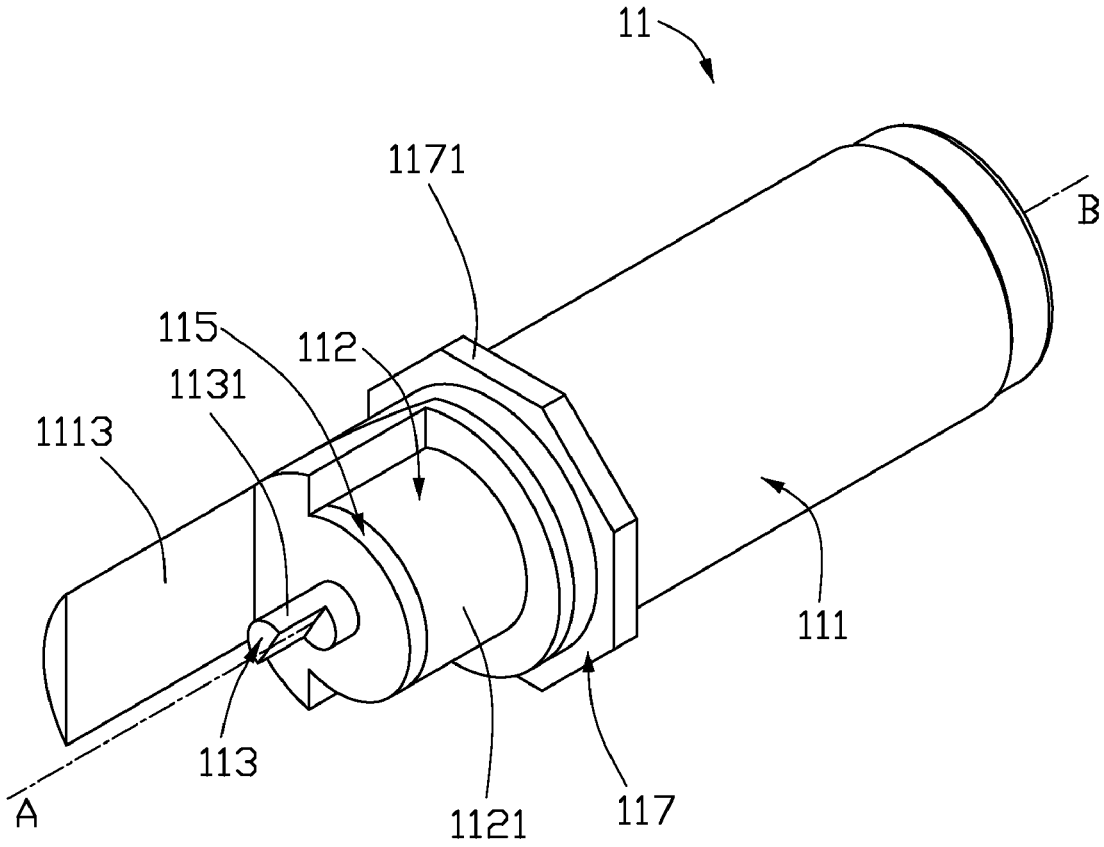
FIG. 2 is an isometric, cut-away view of a terminal module of the cable connector in FIG. 1.
Figure 3:
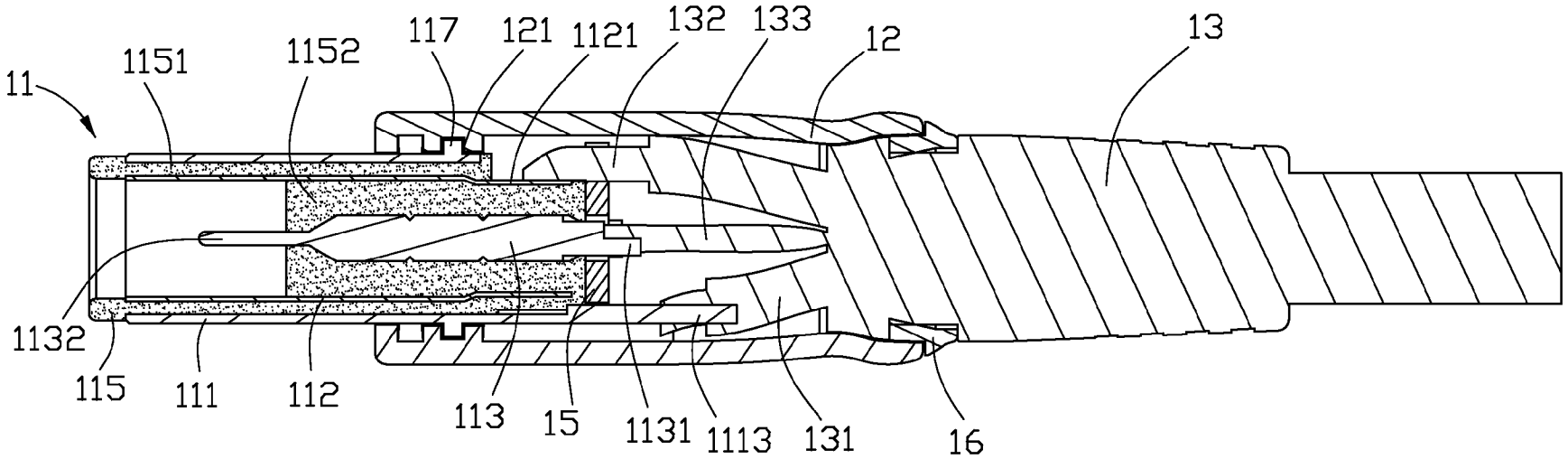
FIG. 3 is a cross-sectional view taken along the line III-III of FIG. 1.

Also referring to FIGS. 2 and 3, the terminal module 11 includes a first terminal 111, a second terminal 112, a third terminal 113, an insulator 115, and a latching flange 117. The latching flange 117 is positioned on an outer surface of periphery of the terminal module 11.

The first terminal 111 is substantially cylindrical. One end of the first terminal 111 forms a first welding portion 1113. The latching flange 117 has an octagonal periphery and is fixed on the outer surface of the first terminal 111. Eight resisting surfaces 1171 are formed on the periphery of the latching flange 117. The eight resisting surfaces 1171 are connected to each other, thereby forming a regular octagon.

The second terminal 112 is substantially cylindrical. One end of the second terminal 112 forms a second welding portion 1121. An outer diameter of the second terminal 112 is smaller than an inner diameter of the first terminal 111. The second terminal 112 is positioned in the first terminal 111 in such a manner that the second terminal 112 and the first terminal 111 have the same axis AB, and the second welding portion 1121 is adjacent to the first welding portion 1113 of the first terminal 111.

The third terminal 113 is substantially cylindrical. One end of the third terminal 113 forms a third welding portion 1131 and the other end of the third terminal 113 forms a metal pin 1132. An outer diameter of the third terminal 113 is smaller than an inner diameter of the second terminal 112. The third terminal 113 is positioned in the second terminal 112 in such a manner that the third terminal 113 and the second terminal 112 have the same axis, and the third welding portion 1131 is adjacent to the second welding portion 1121 and the first welding portion 1113.

The insulator 115 includes a first insulating portion 1151 and a second insulating portion 1152. The first insulating portion 1151 is positioned between the first terminal 111 and the second terminal 112. The second insulating portion 1152 is positioned between the second terminal 112 and the third terminal 113. As a result, the first, the second, and the third terminals 111, 112, 113 are electrically insulated. At the same time, the first, the second, the third welding portions 1113, 1121, 1131, and the metal pin 1132 are all exposed out of the insulator 115.

The housing 12 is substantially cylindrical. An inner surface of the housing 12 defines a latching groove 121. The surface of the latching groove 121 defines eight resisting surfaces (not shown) connected to each other. The latching flange 117 is received in the latching groove 121 in such a manner that the resisting surfaces 1171 abut the resisting surfaces of the latching groove 121, thereby fixing the housing 12 on the outer surface of the first terminal 111.

The cable 13 includes a first core 131, a second core 132, and a third core 133. The first core 131, the second core 132, and the third core 133 are welded to the first, the second, and the third welding portions 1113, 1121, 1131 respectively.

The cable connector 10 further includes a printed circuit board 15 and an indicator 16. The printed circuit board 15 is positioned on the terminal module 11. The third welding portion 1131 is passed though the printed circuit board 15 and is electrically connected to the printed circuit board 15. The indicator 16 is a light emitting diode and is positioned on a connecting portion between the housing 12 and the cable 13. The indicator 16 is electrically connected to the third terminal 113 by the third core 133. When the cable connector 10 is in operation, the third core 133 transmits a control signal to the indicator 16, then the indicator 16 emit light, thereby indicating the status of the cable connector 10.

A method for making the cable connector 10 includes the steps described in the following paragraphs.

First, fabricating a terminal module 11: a first terminal 111, a second terminal 112, and a third terminal 113 are provided. A periphery of the first terminal 111 forms a latching flange 117. A periphery of the latching flange 117 forms eight resisting surfaces 1171 connected to each other, thereby forming a regular octagon. The first terminal 111, the second terminal 112, and the third terminal 113 have a first, a second, and a third welding portions 1113, 1121, 1131 respectively. The second terminal 112 is placed into the first terminal 111, the third terminal 113 is placed into the second terminal 112 in such manner that the first, the second, and the third terminal 111, 112, 113 have the same axis. A plastic material is injected into a space defined by the first, the second, and the third terminal 111, 112, 113, thereby forming the insulator 115. The first, the second, and the third terminal 111, 112, 113 are electrically insulated by the insulator 115.

It should be pointed out that, the latching flange 117 can be formed by one of the following methods: i) the latching flange 117 is integrally formed with the first terminal 111 by milling; ii) the latching flange 117 and the first terminal 111 are formed separately at first, then latching flange 117 is fixed on the first terminal 111 by interference fit; or iii) the latching flange 117 is integrally formed with the insulator 115 by injection molding.

In the above mentioned methods, the methods ii) and iii) can save raw materials and reduce a cost. In addition, when the latching flange 117 is integrally formed with the insulator 115 by injection, a through hole needs to be defined in the first terminal 111 such that melted plastic material is capable of passing through the through hole to form the latching flange 117 on the periphery of the first terminal 111.

The first, the second, and the third terminals 111, 112, 113 are, preferably, made of a conductive metallic material such as brass. The first, the second, and the third terminals 111, 112, 113 can be formed by the methods such as die-casting, extrusion, forging, punching, and so on. In addition, a metallic film can also be formed on an outer surface of the first, the second, and the third terminals 111, 112, 113. The metal film is, preferably, nickel film. A material of the insulator 115 can be polymer such as polyaceyal resin (POM).

Secondly, fabricating the housing 12 by injection molding. An inner surface of the housing 12 forms a latching groove 121, and an inner surface of the latching groove 121 forms eight of the resisting surfaces connecting to each other correspondingly. The housing 12 consists of two symmetrical parts. The two symmetrical parts engage with each other to form a cavity. Therefore, components such as the terminal module 11 and the cable 13 can be easily fixed in the housing 12.

Thirdly, a cable 13, a printed circuit board 15, and an indicator 16 are provided. The cable 13 includes a first core 131, a second core 132, and a third core 133. The terminal module 11 is mounted in the housing 12 in such a manner that the latching flange 117 is received in the latching groove 121, and the resisting surfaces of the latching flange 117 resist the resisting surface of the latching groove 121. The printed circuit board 15 is mounted in the housing 12 and is positioned on the terminal module 11 adjacent to the third welding portion 1131. The third welding portion 1131 is passed through the printed circuit board 15 and electrically connected to the printed circuit board 15. The cable 13 is positioned in the housing 12. The first, the second, and the third cores 131, 132, 133 are welded to the first, the second, and the third welding portions 1113, 1121, 1131 of the terminal module 11 respectively. The indicator 16 is positioned in the housing 12 and electrically connected to the cable 13. Pins (not shown) of the indicator 16 are electrically connected to the third core 133. Finally, two symmetrical parts of the housing 12 are combined by a method of pasting or latching. The latching flange 117 is received in the latching groove 121 of the housing 12 in such manner that the resisting surfaces of the latching groove 121 abut the resisting surfaces 1171 of the latching flange 117.

When the terminal module 11 is positioned in the housing 12, the latching flange 117 engages in the latching groove 121. As a result, the terminal module 11 is fixed in the housing 12. In addition, the latching flange 117 is tightly latched in the latching groove 1112 to prevent the terminal module 11 from detaching from the housing. Furthermore, at least one resisting surface of the latching groove 121 abuts the latching flange 117 for preventing the terminal module 11 from rotating, thereby preventing damage to the cable connector 10.

It can be understood that, a filling plastic can be filled into a space defined by the housing 12, the terminal module 11, the printed circuit board 15, and the cable 13. The filling plastic can fix the first, the second, and the third cores 131, 132, 133 on the housing and protect the welding portion and the printed circuit board 15. The number of the resisting surfaces 1171 of the latching flange 117 can be smaller than or larger than 8, for example 4, 6 or 10. Additionally, the resisting surfaces 1171 can also be spaced with predetermined intervals to each other. In addition, other configuration such as a protrusion or a depression having at least one resisting surfaces, which can fix the terminal module 11 on the housing 12, can be applied to the terminal module 11 and the housing 12. The first, the second terminals 111, 112, and the housing 12 can also be other shape, such as a cuboid barrel shaped tubular.

Finally, while the preferred embodiment has been described and illustrated, the invention is not to be construed as being limited thereto. Various modifications can be made to the embodiments by those skilled in the art without departing from the true spirit and scope of the invention as defined by the appended claims.

What is claimed is:

1. A cable connector comprising:

a terminal module comprising a first terminal, a second terminal, and an insulator, wherein the first terminal and the second terminal are insulated by the insulator;

a housing being fixed on a periphery of the terminal module; and a latching flange fixed on an outer surface of the terminal module, wherein the latching flange forms at least one resisting surface, an inner surface of the housing defines a latching groove, the latching groove forming at least one resisting surface corresponding to at least one resisting surface of the latching flange, and the latching flange is latched in the latching groove, the latching groove has two circumferential side surfaces opposite to each other, each side surface of the latching groove contacts with a side surface of the latching flange.

2. The cable connector as claimed in claim 1, wherein the latching flange is integrally formed with the insulator.

3. The cable connector as claimed in claim 1, wherein a nickel metal layer is formed on an outer surface of the first and the second terminal, and the insulator is made of polyaceyal resin.

4. The cable connector as claimed in claim 1, wherein the at least one resisting surface of latching flange comprises a plurality of resisting surfaces, at least one resisting surface of the latching groove comprises a plurality of resisting surfaces corresponding to the plurality of resisting surfaces of the latching flange, and the plurality of resisting surfaces of the latching groove resist the plurality of resisting surfaces of the latching flange correspondingly.

5. The cable connector as claimed in claim 4, wherein the plurality of resisting surfaces of latching flange comprises eight resisting surfaces, the eight resisting surfaces are connected to each other, thereby forming an octagonal.

6. The cable connector as claimed in claim 1, wherein the cable connector further includes a third terminal, the second terminal is positioned in the first terminal, the third terminal is positioned in the second terminal, the latching flange is positioned on an outer surface of the first terminal, the first terminal includes a first welding portion, the second includes a second welding portion, and the third terminal includes a third welding portion, the first welding portion is adjacent to the second welding portion and the third welding portion.

7. The cable connector as claimed in claim 6, wherein the insulator includes a first insulating portion and a second insulating portion, the first insulating portion is positioned between the first terminal and the second terminal, the second insulating portion is positioned between the second terminal and the third terminal; the first, the second, and the third welding portions are exposed out of the insulator.

8. The cable connector as claimed in claim 6, wherein the latching flange is fixed on the first terminal by interference fit.

9. The cable connector as claimed in claim 6, wherein the latching flange is integrally formed with the first terminal by machining.

10. A method of making a cable connector comprising:

providing a terminal module, the terminal module comprising a first terminal, a second terminal, and an insulator, wherein the first terminal and the second terminal are insulated by the insulator, an outer surface of the terminal module forms a latching flange, the latching flange forms at least one resisting surface and two circumferential side surfaces opposite to each other;

forming a housing consisting two parts, wherein when the two parts are combined together, an inner surface of the housing forming a latching groove corresponding to the latching flange, and at least one resisting surface is formed on the latching groove;

combining the two parts of the housing together and engaging the latching flange of the terminal module in the latching groove of the housing, the at least one resisting surface of the latching groove resisting the at least one resisting surface of the latching flange, each side surface of the latching groove contacts with a side surface of the latching flange.

* * * * *